United States Patent [19]

Spies

[11] Patent Number: 4,905,777

[45] Date of Patent: Mar. 6, 1990

[54] DEVICE FOR PRODUCING DRILLING HOLES FROM AN ANGLED POSITION WITH RESPECT TO THE DRILLING AXIS

[75] Inventor: Klaus Spies, Aachen-Schmithof, Fed. Rep. of Germany

[73] Assignee: Rudolf Hausherr & Sohne GmbH & Co. KG, Sprockhovel, Fed. Rep. of Germany

[21] Appl. No.: 192,508

[22] PCT Filed: Aug. 27, 1987

[86] PCT No.: PCT/EP87/00488

§ 371 Date: Apr. 29, 1988

§ 102(e) Date: Apr. 29, 1988

[87] PCT Pub. No.: WO88/01677

PCT Pub. Date: Mar. 10, 1988

[30] Foreign Application Priority Data

Aug. 29, 1986 [DE] Fed. Rep. of Germany ..... 3629366

[51] Int. Cl.[4] ..... F21B 17/20; F21C 1/00

[52] U.S. Cl. ..... 175/73; 173/147; 175/78; 384/126; 384/292; 464/57

[58] Field of Search ..... 175/73, 78, 162, 421, 175/323; 299/69; 464/57, 58, 183, 178; 173/34, 35, 36, 32, 33, 43, 43, 73, 147; 384/118, 129, 131, 126, 292, 504, 462, 474; 138/131, 134

[56] References Cited

U.S. PATENT DOCUMENTS

| | | | |
|---|---|---|---|
| 2,644,669 | 7/1953 | Curtis et al. | 175/78 X |
| 2,906,499 | 9/1959 | Travis | 175/78 |
| 4,057,115 | 11/1977 | Blanz | 464/58 X |
| 4,577,703 | 3/1986 | Cyriacy et al. | 175/79 |

FOREIGN PATENT DOCUMENTS

| | | | |
|---|---|---|---|
| 131771 | 1/1985 | European Pat. Off. . | |
| 1586 | 9/1969 | France . | |
| 282230 | 8/1971 | U.S.S.R. | 175/421 |
| 590457 | 1/1978 | U.S.S.R. | 299/69 |

*Primary Examiner*—Thuy M. Bui
*Assistant Examiner*—David J. Bagnell
*Attorney, Agent, or Firm*—Herbert Dubno

[57] ABSTRACT

The invention relates to a process and a device for the production of drilling holes from an angled position with respect to the drilling axis, wherein the system has a free-moving drilling support with a drilling machine axially movable thereon. According to this process the drilling rod is provided with a flexible configuration that is diverted by passing through a bend guide affixed to a drilling support, from the rotation axis of the drilling machine to the axis of the drill hole. According to this device, the flexible drilling rod system consists of a tubular core and of wires or rods twisted around this core.

27 Claims, 7 Drawing Sheets

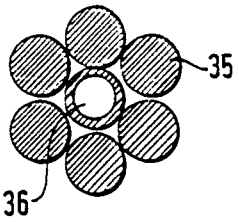
FIG. 5
FIG. 6
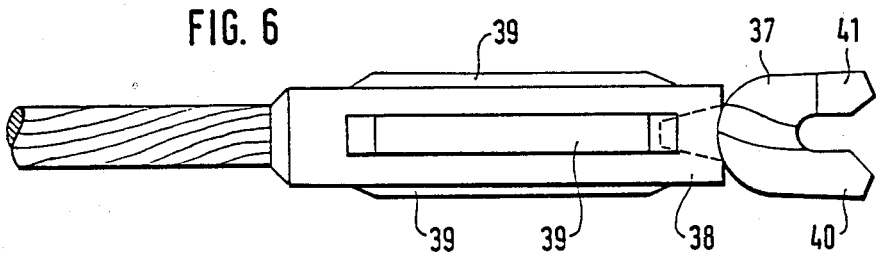

DEVICE FOR PRODUCING DRILLING HOLES FROM AN ANGLED POSITION WITH RESPECT TO THE DRILLING AXIS

FIELD OF THE INVENTION

The invention relates to a process and a device for the production of drilling holes from an angled position with respect to a drilling axis, wherein the mechanical and technical system selected for the production of drilling holes has a freely moving drilling support and a drilling machine axially movable thereon.

BACKGROUND OF THE INVENTION

Angled drilling is necessary and useful wherever drilling holes have to be made starting from narrow spaces. These holes usually require a length longer than the geometric measurements of the spaces. In the case of narrow limitations where two space coordinates in whose plane the drill hole (s) have to be made, there is enough room in the direction of the third coordinate perpendicular to this plane for the drilling device and its' advance, which has to correspond to the depth of the drilling hole.

For the above-mentioned reasons, angled drilling is particularly suitable in mining and tunnel construction. This suitability derives from the space limited cross section of mining and tunnel galleries which in most cases is coupled with sufficient length, for instance in shafts, blind shafts, galleries, tunnels, rises and struts.

Devices have been known for many years which drill holes from an angled position with respect to the drilling hole axis. These devices have attempted to overcome the afore-described difficulties, especially in mining and tunnel construction, to produce drilling holes out of narrow spaces, holes whose length is considerably bigger than the measurements of the underground spaces. All these efforts have up to now however not been successful. These failures have been due to process disadvantages and to relatively high costs. None of the devices heretofore known have been suitable for industrial use.

A known drilling process, which has not yet yielded successful results after years of industrial testing, has a particularly "flexible shaft" consisting of two oppositely twisted wire springs with special wire diameter, lodged one within the other. Usually this shaft can be angled. During the transmission of torque required for drilling, the inner spiral is supposed to widen, while the diameter of the outer spiral is supposed to decrese. As a result, a certain stiffening effect is supposed to occur. However, this theoretically established modus operandi did not perform well in practice for industrial use, even after many years of attempts and of successive improvement stages.

Another process is based on the idea to produce drilling holes with the aid of the "maximum-pressure water technique" (HDW-German abbreviation). Maximum-pressure hoses are flexible and because of this seem to be suited for angled drilling. Rotary transmissions, have been developed which theoretically have potential for long service life, in spite of the high strain they are subjected to. At this point of development, the process could be expected to produce good results in industrial testing. Although with the principle of HDW-drilling it is possible for the first time to expect in all pobability an industrially applicable process for an angled drilling of drill holes, it is still necessary to accept a series of technological and cost disadvantages. Although the HDW-technique has many advantages, it does not allow for drilling holes with smooth wallings. For this reason, this technique is mainly suited for the production of armature holes, but less for the production of shot holes. In the exclusive drilling with maximum-pressure water, based on present knowledge, the drilling advance will not be unsubstantially less than the drilling advance in the case of rotary or rotary percussion drills. Besides, when drilling exclusively with maximum-pressure water there results during the drilling time a very considerable volume of water and detritus flow for which separate evacuation installations have to be provided. A large detritus flow arises because rocks surrounding the mining area often are sensitive to water and under its influence experience a decrease in their solidity.

SUMMARY OF THE INVENTION

The invention has the object to avoid the disadvantages of the afore-mentioned known processes. It follows the concept of a flexible rod of a particular structure, which allows the transmission of high pressure forces and high torque and is deviated and guided in a firmly preestablished bend. The device on which the invention is based and which can be mounted on normal (and thereby on already available) drilling supports, as opposed to all heretofore proposed processes, makes possible also the use of rotary-percussion, or percussion-rotary drills. These two drilling concepts, in comparison to purely rotary and other drilling, and in combination with the results heretofore obtained in angled drilling, render possible a considerably higher drilling efficiency. The combination also allows holes to be drilled with satisfactory advances in rocks which are difficult to drill.

The process according to the invention is particularly well suited for the production of shot- and armature holes. However, it is also appropriate for the production of drill holes serving entirely different purposes. Special utility for this process exists for the production of drill holes for armatures in mining gallery advances with partial cutting machines, in the anchoring of strut areas susceptible to cave-ins and in the production of shot holes in the seam floor of the opening-out rises.

In the opening of mining galleries with partial cutters, when rock anchors are used for exclusive or additional gallery consolidation, it is possible to have an overlapping in time of the cutting operation and the consolidation operation only then when the entire consolidation operation is limited to an area with a relatively reduced cross section, at the utmost end of the gallery. This implies that the armature holes are drilled from a position parallel to the axis of the gallery "around the corner" into the rock surrounding the gallery, the armature being subsequently fitted in the same manner. Presently, the length of the armature holes ranges between 2.2 and 2.5 m. Longer armatures might become necessary at lower depths due to the expected higher pressure loads. The area available at the gallery lining, where the drilling and the anchoring takes place, has spatial movements of 50 to 70 cm, i.e. the drill holes are at least three to five times as long as the free space available in the drilling hole axis.

The same applies to the struts in layers with reduced thickness, where in the areas exposed to cave-ins, particularly between the horn and the coal face, as well as in areas with disturbances in the rock mechanics, relatively long rock anchors have to be driven in, whose length equals a multiple of the later thickness and thereby of the strut opening. Up to now, short drilling rods have been used, threaded one into the other corresponding to the drilling advances, whose dimensions correspond to the strut opening. The process is very time-consuming and expensive, the former being particularly adverse on safety operations in areas endangered by cave-ins where drilling must be very quick.

A further clever application of the invention is made possible due to a development trend, according to which at greater depths, for reasons of rock mechanics, the mining galleries have to be arranged in seam floors. Thereby, it is further suitable to precede by a short strut the actual opening place of the mining gallery, i.e. the point where the ripping of the floor rock occurs. In this process it is advisable to drill the shot holes vertically with respect to the gallery axis, i.e. in the so-called manner of stooping construction.

With that length of the drilling holes, this is possible only through angled drilling. In the case of smaller layer thicknesses it is also necessary to produce the drilling holes for the temporary work between the preceding strut and the final gallery consolidation with the aid of angled drilling.

Primarily in the coal mining industry of the United States, Australia and the Republic of South Africa, board-and -pillar face working is preponderently used. Therein the resulting hollow spaces have to be consolidated with armatures against possible cave-in of the hanging rock strata. The mining takes place in many cases in layers with reduced thickness. Armatures have to be driven in, to safeguard the mining spaces, the length of these armatures being considerably bigger than the layer thickness. This also offers a preferred field of application for the angled drilling with flexible drilling rod.

BRIEF DESCRIPTION OF THE DRAWING

An embodiment of the invention is described in detail with the aid of the drawing, which shows:

FIG. 5 a cross section through a flexible drilling rod assembly;

FIG. 6 a frontal view of the flexible drilling rod assembly with mounted annular bit;

DETAILED DESCRIPTION

Figure 1:
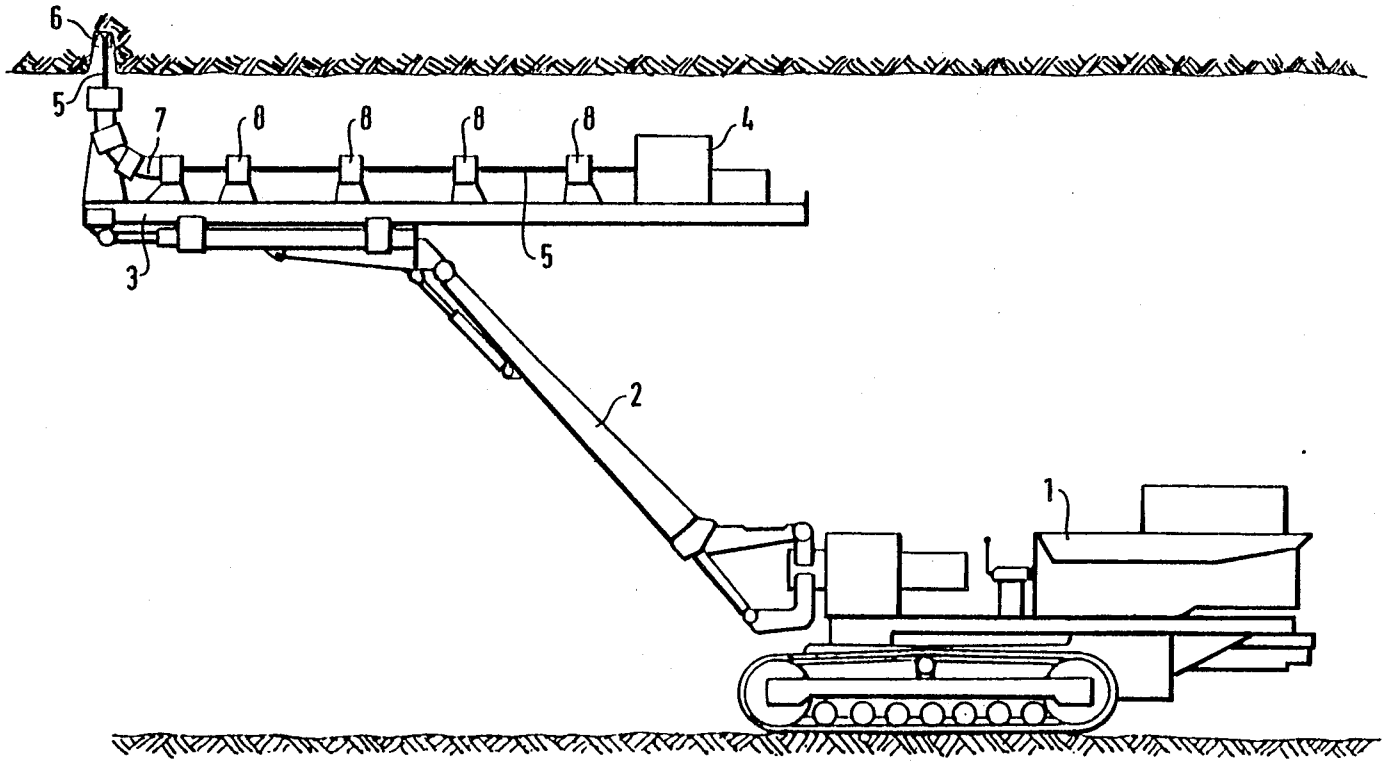
FIG. 1 a general view of the drill cradle, with drilling support and the device for angled drilling according to the invention mounted thereon.

FIG. 1 shows the drilling device for drilling at an angle on the drill cradle 1 with a rotatable and swingable arm 2 and a free-moving support 3 mounted to its free end. The drilling device according to the invention can be mounted just as well on a drill cradle with wheel drive, on a propulsion unit, on a crawler or suspended from an overhead track.

On the free-moving support 3, a drilling machine 4 can be moved in an axial direction. This machine can be a rotary drill, a rotary percussion drill or a percussion rotary drill machine, having built-in advance mechanisms. On a stump of a driven shaft of the rotary drilling machine 4, a flexible drilling rod assembly 5 is mounted in an easily detachable manner, and an annular bit 6 is affixed to its frontal end. Further, on the support 3, a bend guide 7 is mounted, as well as slideable bearings 8, which have the function of guiding the flexible rod 5 between the drilling machine 4 and the bend guide 7. When the drilling machine 4 advances during the drilling operation, the movable bearing blocks 8 are first released and then entrained by the drilling machine and moved against the bend guide 7. In the return process of the flexible drilling rod 5, blocks 8 are again entrained and returned to their initial position and locked again therein.

Figure 9:
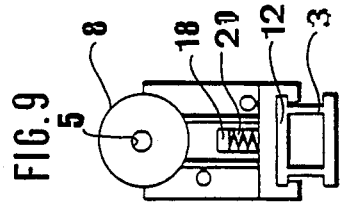
FIG. 9 a cross section along line A—A of FIG. 2.
Figure 2:
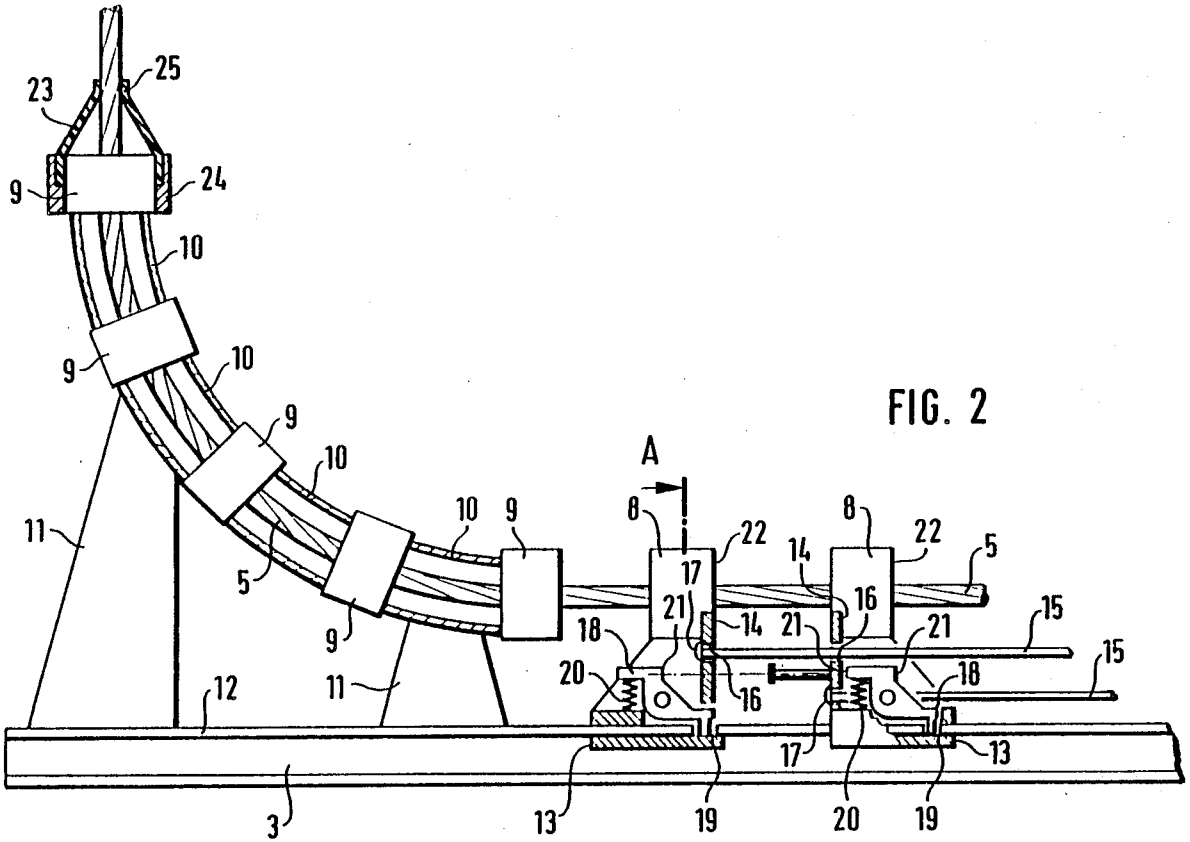
FIG. 2 a frontal end of the drilling support with a bend guide mounted thereon.

In FIG. 2, the frontal end of the drilling support 31 is shown, with the bend guide 7, the first two slidable bearings, the advance and restoring mechanisms, as well as the locking mechanisms. A variant of the bend guide concept utilizes bearing blocks 9 and pipe segments 10 arranged therebetween, preferably welded to each other. In FIG. 2 the bearing blocks 9 are shown in frontal view, while the pipe segments 10 are shown in the FIG. 9 cross section. Corresponding to the buckling strength of the flexible rod 5, the spaces between the bearing blocks can be of varying size. They can reach, for instance, 20 to 30 cm in the case of drilling armature bores, with very buckling-resistant drilling rods, or the size can approach zero, i.e. the bearing blocks 9 touch each other directly and the pipe-shaped intermediate spaces 10 are eliminated altogether, as is the case with a less buckle-resistant drilling rod. The flexible rod 5 is guided concentrically through the bearing blocks 9 and the pipe-shaped intermediate segments 10. The bend guide is rigidly connected to the drilling support 3 via a fastening member 11, preferably bolted or welded.

The drilling support 3, serving as a guide, and slide track for the drilling machine and the movable bearing block 8, can be built in various ways; in the illustrated embodiment, it consists of two I-beam tracks, whose upper outer flange 12 is straddled by corresponding claw-like guiding elements 13 of the slidable bearing blocks 8 of the drilling machine.

Preferably, on both sides of the slidable bearing blocks 8 there are wings 14, to which reset mechanisms, 15 of various length are mounted. The reset mechanisms, which are preferably also mounted on both sides of the slidable bearing blocks, can consist of rods or cables. Assigned to each slidable bearing block 8 is a pair of rods or cables. The rods or cables are fastened to the drilling machine at their ends which are not shown in the drawing. They can be unilaterally fastened, i.e. either to the drilling machine 4 or to the movable bearing blocks 8 and have to be axially displaceable in corresponding bores at the other respective end, so that during the resetting of the flexible drilling rod 5 they can be retracted to their original position. In the illustrated embodiment, resetting mechanisms 15 consist of rods fastened to the drilling machine 4, while they pass through bores 16 of lateral wings 14 of the slidable bearing blocks 8. During the resetting process, impact heads 17 of the cables or rods serving as resetting mechanisms come to lie against the lateral wings 14 of the slidable bearing blocks 8, so that during the return of the drilling machine 4 and of the flexible drilling rod 5, the bearing blocks 8 are reset geometrically precise in their initial position, as shown in FIG. 2.

Locking mechanisms 18 mounted to each slidable bearing block 8, engage in respective bores 19 of the outer upper flange of the I-beam support tracks, welded to each other, serving as guide support 3. Via springs 20, the locking mechanisms 18 are pressed into the bores 19, so that a form-fitting locking occurs. During the drilling process, each of the adjacent bearing blocks push with a corresponding nose against surfaces 21 of the locking mechanisms 18, so that these can be rotatably withdrawn from the bores 19 with their free ends, against the action of springs 20 and thereby unlocked. The drilling machine 4 presses then with an advance mechanism, not shown in the drawing, against frontal surface 22 of the first bearing block, and each bearing block 8 against its neighbor 8 considered in the direction of the drilling, so that these are entrained during the further drilling process.

The last bearing block at the end of the bend guide, which is closest to the bore hole, is surrounded by a gasket 23, braced to the bearing block by clamps 24, which gasket also surrounds sealingly with its free end the flexible drilling rod 5, so that no water or borings can penetrate the bend guide.

Figure 3:
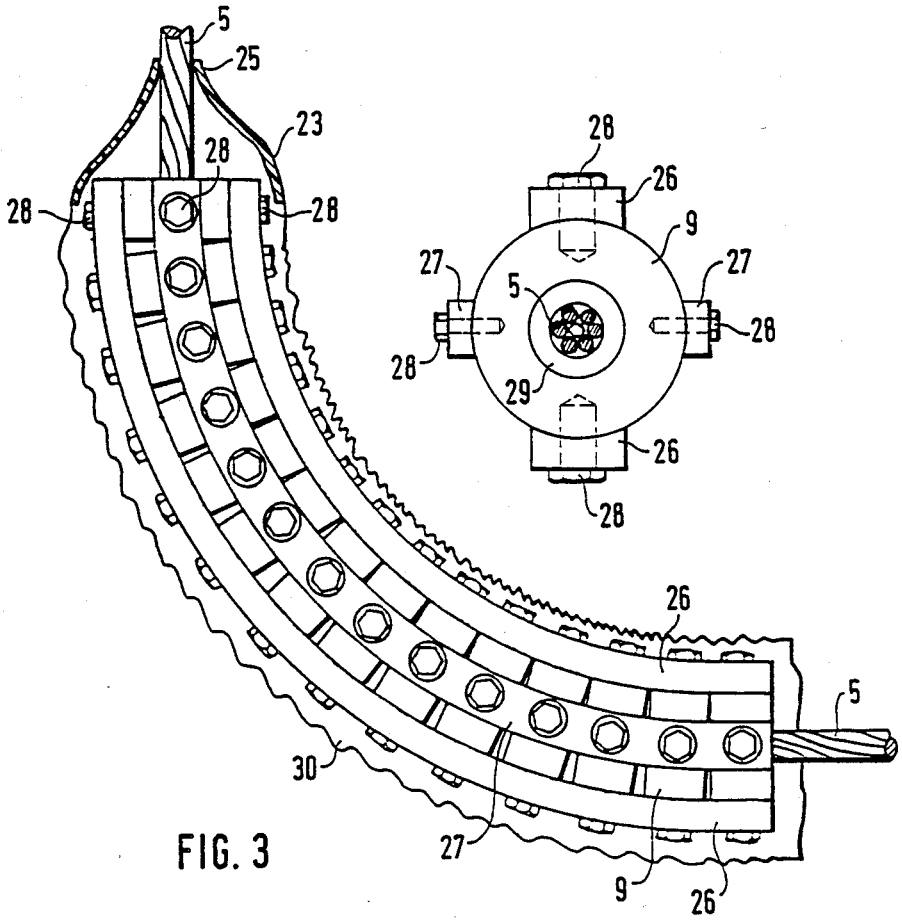
FIG. 3 a bend guide for the flexible drilling rod, with the use of self-aligning bearings.

In FIG. 3, a construction variant of the bend guide is represented, wherein the bearing blocks 9 are arranged immediately one next to the other. In order to achieve a buckling-free bend guide, in this embodiment example, two pairs of strong ledges 26, 27 are provided at the outer surfaces of the bearing blocks 9, these pairs of ledges being offset by 90° with respect to each other, the ledge pair 26 having a larger cross section and therefore a higher resistance moment than the ledge pair 27, since the first one has to absorb the forces in the bend guide resulting from the pressing force. The ledge pairs are fastened by screws 28 to the bearing blocks 9, so that considered in general, an extremely rigid bend guidance results. In each of the bearing blocks 9, the flexible drilling rod 5 is surrounded by a rotatable guide piece 29. For the purpose of shutting out the water and borings, the entire bend guide is covered with accordion-like sealing hose 30 made of rubber or synthetic material, which ends in sealing collar 23 at its end facing the bore hole, which collar is sealingly pressed against the flexible drilling rod 5 with its lips 25.

Figure 4:
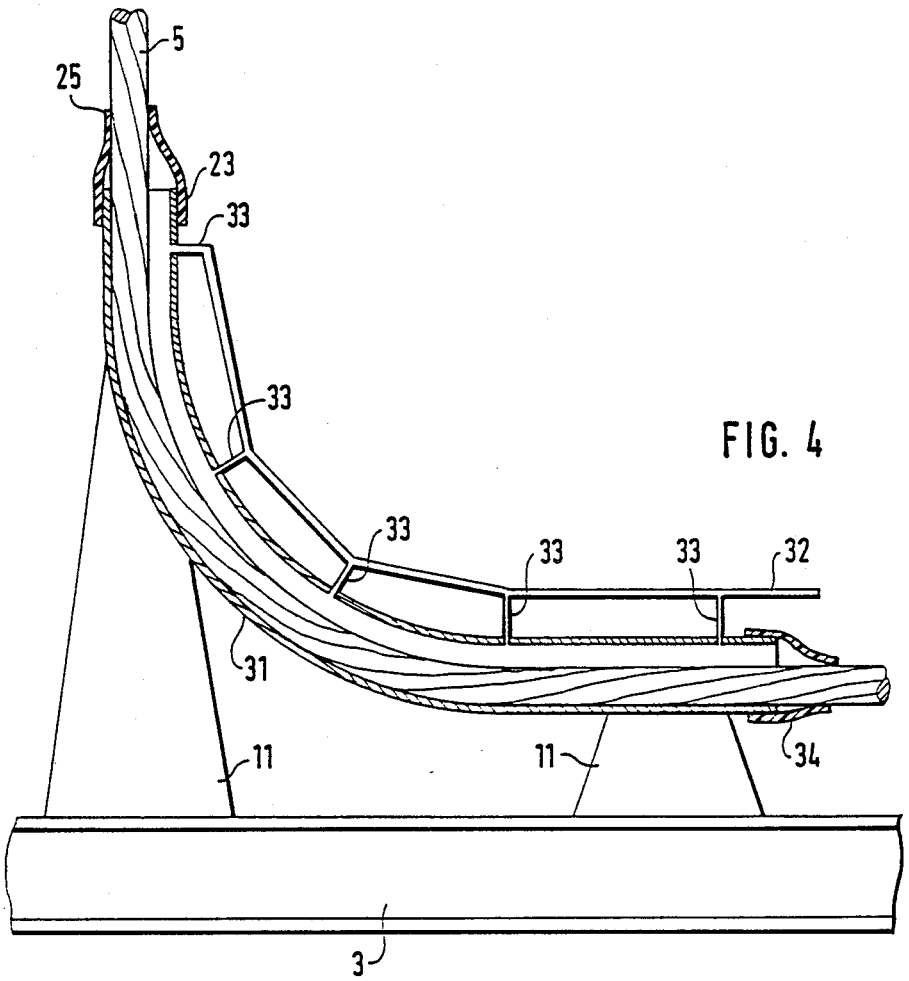
FIG. 4 a bend guide for the flexible drilling rod, with the use of a sleeve bearing.

FIG. 4 shows an embodiment example of the bend guide, wherein the flexible drilling rod 5 is slidably supported with sufficient play within a curved pipe 31. The pipe-shaped bend guide is provided at its end on the bore hole side with a sealing collar 23 which presses sealingly against the flexible drilling rod 5 with its lips 25, similar to the embodiment examples according to FIGS. 2 and 3. Likewise to the other embodiment examples (according to FIGS. 2 and 3) the bend guide is rigidly connected to the drilling support 3, through legs 11, so that during the deflection process as a result of the pressing forces, the corresponding deflection forces can be transmitted to the drilling support 3.

The pipe-shaped bend guide is supplied with grease via lubrication duct 32 and lubrication holes 33, in order to diminish the friction resistance between the flexible drilling rod and the angle guide. The lubrication system is connected to a lubrication pump not shown in the drawing, which is actuated from the drilling machine 4, so that during the drilling operation lubricants are constantly supplied. Also at an end of the drilling machine side of the pipe-like bend guide, there is a gasket 34, to prevent the escape of lubricant on this side.

Laboratory tests have shown that it is perfectly possible in the presence of forces of the kind which develop during the drilling of shot holes or armature bores, to build the bend guide as a lubricated sleeve bearing.

FIG. 5 shows a possible cross section of the flexible drilling rod 5. The drilling rod assembly is made after the fashion of a cable-wire rope (reinforced concrete strand) of relatively strong wires or rods 35, which are wrapped with a relatively low twisting factor around tube-shaped core 36. The sense of rotation of the moment in the case of the rotary drilling, rotary percussion drilling or percussion rotary drilling has to correspond to the direction of the spin during twisting. The core 36 is tube-shaped, so that necessary flushing liquid can be supplied to the annular bit.

The twisting factor can be relatively small; it is possible to have embodiments wherein the twisting factor is as low as two to three circumrevolutions per meter of flexible drilling rod. Similarly to the reinforced concrete strands, spring steel or spring-steel-like materials can be used, in order to resist the high alternating flexture stresses to which the drilling rods are exposed in the area of the bend guide.

The number of rods, or wires 35, which are wrapped around the hollow core 36 can vary to a great extent. It depends on the diameter of the drill hole and on the therefrom resulting torque and pressing forces. The flexible drilling rods as previously described are extraordinarily stable against buckling, so that according to the embodiment example shown in FIG. 2 the space between the bearing blocks 9 in the bend guide 7 and the spaces between the movable bearing blocks 8 can be relatively large. The high buckling strength and the special construction of the flexible drilling rod according to FIG. 5 makes possible transmission of percussions over the rod system, so that in spite of the angling, rotary percussion-and percussion rotary drilling are possible.

In FIG. 6 is represented an embodiment example for the fastening of the annular bit to the flexible drilling rod according to FIG. 5. Annular bit 37 is inserted with its standardized fastening means in the annular bit holder 38, provided with four ribs 39, offset with respect to each other by 90° . Corresponding to the rock to be drilled and selected drilling method, the annular bit can have a great variety of configurations, and can be provided with two or more drill cutters 40, which preferably are reinforced by hard-metal plates.

The fastening means between the annular bit holder and the flexible drilling rods can also be of great variety. The annular bit holder, hollow on the inside, can consist of cold rolled steel pressed on the flexible drilling rod with high pressing forces (according to FIG. 5). This way a sufficiently high adhesion results to make possible the transmission of the torque, the pressing forces and the percussion load and also to prevent from being stripped away when the drilling rod is retracted.

According to another embodiment example, it is also possible to solder or weld the annular bit holder to the flexible drilling rods. When the drilling rods are made of spring steel or spring-steel-like materials, a hard-soldering connection is recommended.

Diameters of the flexible rod, the annular bit holder and of the annular bit are stepped up with respect to each other.

Figure 7:
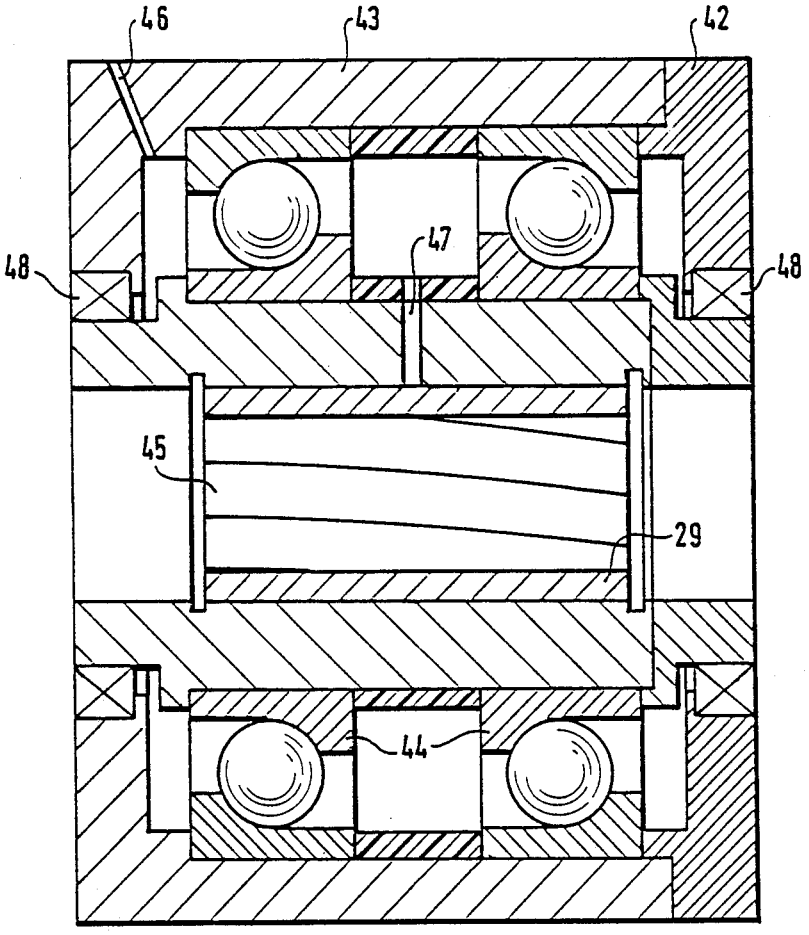
FIG. 7 a cross section through a self-aligning bearing block.

FIG. 7 shows a section of a possible embodiment example for the bearing block 8 and 9. In housing 43 closed by a lid 42, two detachable journal bearings 44 are arranged, which together allow for the absorption of the axial forces in both directions. Inside the detachable journal bearings, is a sliding sleeve forming the guide piece 29, preferably made of antifriction metal, which has spiral-shaped recesses 45, wherein the loosely twisted rods or wires 35 of the flexible drilling rod 5 can be moved axially with respect to the bearing blocks 8 and 9. A lubricating system with holes 46 and 47 provides for sufficient lubrication of the detachable journal bearings 44, as well as of the recesses 45 meant to accommodate the axial movement and located between the drilling rods 5 and the guide piece 29. The sealing rings 48 arranged on both sides of the bearing blocks prevent penetration of water and detritus and the escape of the lubricant.

Instead of the detachable journal bearing, self-aligning roller bearings can be used in another embodiment example.

Figure 8:
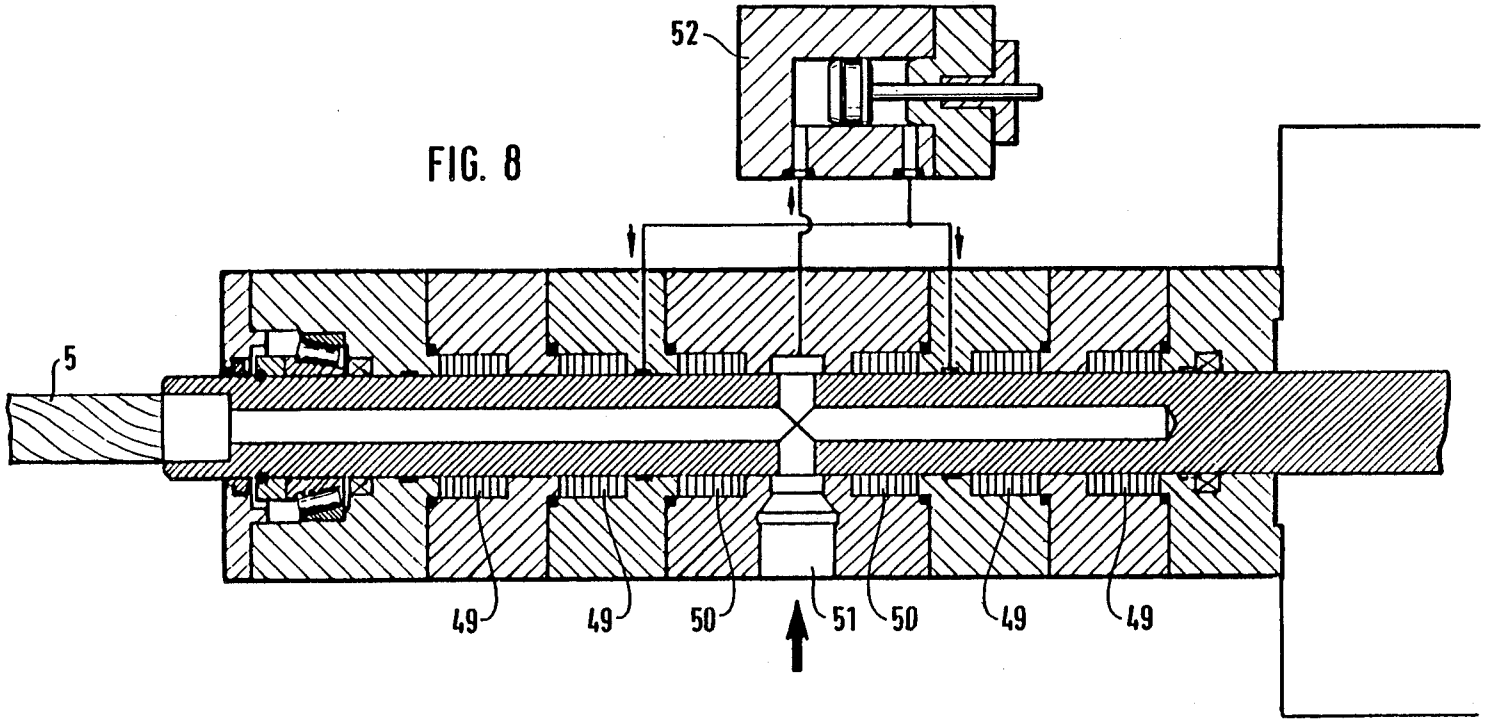
FIG. 8 an embodiment example with a rotary transmission for the supplementary application of the maximum-pressure-water technique.

In order to assist the work of the drill cutting edges 40 on the annular bit 37 by high-pressure water jets and this way to substantially increase once more the advance of the drill, it is possible to mount on the drilling machine 4 maximum-pressure rotary transmission, according to FIG. 8. The assistance of rotary or rotary percussion drilling by maximum-pressure water jets for the purpose of increasing drilling efficiency does not incur the disadvantages of high-pressure water techniques associated within the prior art previously described in the specification.

The rotary transmission consists of 2×3 gasket sets 49, 50, arranged symmetrically on both sides of the maximum-pressure water supply duct 51. The two gasket sets 50 which are closest to the high-pressure water supply are acted upon their back sides by oil with high viscosity, which is brought up to a pressure increased by 5 to 10% with respect to the maximum-pressure water in a pressure converter 52. This way the mostly endangered gaskets 50 are relieved of pressure and lubricated at the same time.

I claim:

1. Device for forming drill hole from an angled position with respect to a longitudinal axis of said drill hole comprising:

a freely movable drilling support;

a drilling machine supported by said support drilling and movable along a rotation axis relative to said support;

a bend guide mounted on said drilling support;

a flexible drilling rod passing through said bend guide from the rotation axis of said drilling machine to the longitudinal axis of said drilling hole, said rod including a tubular core and a plurality of wires twisted around said core, said twist being no more than three circumrevolutions per meter of drilling rod.

2. Device according to claim 1 wherein both the tubular core and the wires twisted around it are made of a substance selected from the group consisting of spring steel and spring-steel-like material.

3. Device according to claim 1 further comprising an insertion device pressed onto an end of said drilling rod and an annular bit held in said insertion device, each being made of a cold formable material.

4. Device according to claim 1 further comprising an insertion device fastened to an end of said drilling rod through a hard-soldering or welding connection and an annular bit held in said insertion device.

5. Device according to claim 1 further comprising an insertion device positioned on an end of said drilling rod and an annular bit held in said insertion device, said device having guide ribs running parallel to said drilling rod.

6. Device according to claim 1 further comprising bearing blocks along said bend guide having self-aligning bearings.

7. Device according to claim 6 wherein the self-aligning bearings have a detachable journal bearing which makes possible absorption of axial forces in both directions.

8. Device according to claim 1 further comprising bearing blocks along said bend guide.

9. Device according to claim 8 further comprising pipe-segment spacers between the bearing blocks.

10. Device according to claim 9 wherein the pipe-segment spacers have a length that is smaller than a critical buckling load of the flexible drilling rod under occurring moments, pressure forces and percussion strains.

11. Device according to claim 8 wherein the bearing block closest to the drilling hole is provided with a cuff-like gasket which presses sealingly with its lips against the flexible drilling rod.

12. Device according to claim 8 wherein the bearing blocks are mutually connected through four bent ledges which are offset with respect to each other by 90°.

13. Device according to claim 8 further comprising arresting means releasable at an impact of corresponding parts of neighboring bearing blocks via a control cam and that subsequently the bearing blocks can be displaced on the drilling support in the direction of the bend guide.

14. Device according to claim 8 wherein a force causing displacement of the bearing blocks is applied to their frontal surfaces by the drilling machine or by a neighboring bearing block and transmitted this way.

15. Device according to claim 8 wherein the bearing blocks are connected to the drilling machine over resetting devices of variable length, which during restoring of the flexible drilling rod entrain the bearing blocks from sliding and fasten them again in their initial position.

16. Device according to claim 8 further comprising resetting devices provided between the drilling machine and the bearing blocks are fixed at one of their ends and at an other end they are arranged in a frictional connection, with heads serving as stoppers in corresponding bores.

17. Device according to claim 8 further comprising self-aligning roller bearings arranged in the bearing blocks, with a guide piece which can run along their inner circumference and having spiral-shaped recesses on its inner surface, wherein the wires of the flexible rod can be axially displaced.

18. Device according to claim 17 wherein the guide piece is made of antifriction metal.

19. Device according to claim 8 wherein the bearing blocks consist of two detachable parts, in order to make possible building in of a self-aligning bearing, of spacing bushings, as well as of a guide piece.

20. Device according to claim 19 wherein lubrication holes are provided, through which the self-aligning bearings and a slide groove, as well as the wires of the flexible drilling rod can be lubricated.

21. Device according to claim 8 wherein the bearing blocks are protected by annular gaskets against penetration of water or detritus, and any escape of lubricant.

22. Device according to claim 1 wherein the bend guide is a tubular slide bearing having respective ends with cuff-like gaskets at said ends.

23. Device according to claim 22 wherein the tubular bend guide is provided with lubricant inlets at particularly suitable locations, which are connected to a lubricant supply duct.

24. Device according to claim 1 further comprising slidable bearing blocks assigned to the drilling rod in an area of the rod running parallel to the drilling support, whose mutual distance is also smaller than a critical buckling length of the drilling rod under the occurring loads.

25. Device according to claim 1, further comprising slidable bearing blocks supported on legs which grip the drilling support with sufficient play, by means of claw-like guide elements.

26. Device according to claim 25 wherein on the support legs of the slidable bearing blocks lockable and releasable arresting means are mounted, which engage in a corresponding recess of the drilling support.

27. Device according to claim 1 wherein a symmetrically constructed rotary transmission for maximum-pressure water is associated with the drilling machine, the transmission having main gaskets relieved of pressure by means of a pressure converter and an auxiliary cycle of high-viscosity oil.

* * * * *